US008851647B2

(12) United States Patent
Ito

(10) Patent No.: US 8,851,647 B2
(45) Date of Patent: Oct. 7, 2014

(54) LIQUID EJECTING APPARATUS

(71) Applicant: Seiko Epson Corporation, Tokyo (JP)

(72) Inventor: Hiroyuki Ito, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/751,547

(22) Filed: Jan. 28, 2013

(65) Prior Publication Data

US 2013/0194326 A1 Aug. 1, 2013

(30) Foreign Application Priority Data

Jan. 30, 2012 (JP) ..... 2012-016388

(51) Int. Cl.

| | |
|---|---|
| ***B41J 2/175*** | (2006.01) |
| ***B41J 2/18*** | (2006.01) |
| ***B41J 2/17*** | (2006.01) |
| ***B41J 25/34*** | (2006.01) |

(52) U.S. Cl.

CPC ..... *B41J 2/1707* (2013.01); *B41J 25/34* (2013.01); *B41J 2/175* (2013.01)

USPC ..... 347/89; 347/85

(58) Field of Classification Search

USPC ..... 347/40, 41, 43, 84–86, 89, 95

See application file for complete search history.

(56) References Cited

U.S. PATENT DOCUMENTS

| | | | | |
|---|---|---|---|---|
| 7,661,805 | B2 * | 2/2010 | Usui | 347/92 |
| 8,308,252 | B2 * | 11/2012 | Shimoda | 347/6 |
| 2013/0021396 | A1 * | 1/2013 | Hirano | 347/6 |

FOREIGN PATENT DOCUMENTS

| | | |
|---|---|---|
| JP | 2008-055716 | 3/2008 |

* cited by examiner

*Primary Examiner* — Hai C Pham

(74) *Attorney, Agent, or Firm* — Workman Nydegger

(57) ABSTRACT

Disclosed herein is a liquid ejecting apparatus including: a liquid ejecting head having nozzles that eject a liquid; a plurality of liquid flow passages where the liquid to be supplied to the liquid ejecting head flows; and a heating portion that heats the liquid in the liquid flow passages, in which the liquid flow passages include circulation passages where at least a part of the liquid supplied to the liquid ejecting head is circulated to upstream of the heating portion by being discharged from the liquid ejecting head without passing through the nozzles; and non-circulation passages where the liquid supplied to the liquid ejecting head is not able to be circulated to upstream of the heating portion by being discharged from the liquid ejecting head without passing through the nozzles, and in which the circulation passages are disposed at outer sides of the other liquid flow passages.

4 Claims, 7 Drawing Sheets

LIQUID EJECTING APPARATUS

BACKGROUND

1. Technical Field

This claims priority to Japanese Patent Application No. 2012-016388 filed on Jan. 30, 2012. The entire disclosure of Japanese Patent Application No. 2012-016388 is expressly incorporated by reference herein.

The present invention relates to a liquid ejecting apparatus.

2. Related Art

An ink jet type printer has been known as a recording apparatus which records images, letters or the like on a recording medium by ejecting a liquid. In the ink jet type printer, for example, when the ink having a relatively high viscosity is applied, it is important to manage the viscosity of the ink in order to obtain a good ejection property of the ink. Therefore, a technique capable of stabilizing the ink ejection property by providing a fluid flow passage through which a fluid for heating the ink in the ink jet head flows so as to maintain the temperature of the ink substantially uniform and to constantly maintain the ink viscosity, has been proposed (for example, see JP-A-2008-055716).

However, in the related art mentioned above, there are problems, such as a temperature decrease in the ink in an ink jet head which is cooled by air impacting due to the movement of the ink jet head.

SUMMARY

An advantage of some aspects of the invention is to provide a liquid ejecting apparatus capable of stabilizing the temperature of an ink to be supplied to an ink jet head.

According to an aspect of the invention, there is provided a liquid ejecting apparatus which includes: a liquid ejecting head having nozzles which eject a liquid; a plurality of liquid flow passages where the liquid to be supplied to the liquid ejecting head flows; and a heating portion which heats the liquid in the liquid flow passages, in which the liquid flow passages include circulation passages where at least a part of the liquid supplied to the liquid ejecting head is circulated to upstream of the heating portion by being discharged from the liquid ejecting head without passing through the nozzles; and non-circulation passages where the liquid supplied to the liquid ejecting head is not able to be circulated to upstream of the heating portion by being discharged from the liquid ejecting head without passing through the nozzles, and in which the circulation passages are disposed at outer sides of the other liquid flow passages.

According to the liquid ejecting apparatus of the aspect of the invention, since the liquid, which is circulated to upstream of the heating portion through the circulation passage, is heated again and then supplied to the liquid ejecting head, it is possible to maintain the liquid flowing in the circulation passage in a state where the liquid is heated to a predetermined temperature. Therefore, since the circulation passage is disposed to the liquid flow passage which is positioned at the end portion where the temperature decrease easily occurs by the movement of the liquid ejecting head, among a plurality of the liquid flow passages, the temperature of the liquid to be supplied to the liquid ejecting head may be stabilized. Thereby, the temperature of the liquid to be supplied to the liquid ejecting head may be stabilized even in the configuration where the liquid ejecting head moves.

In the above-mentioned liquid ejecting apparatus, it is preferable that a carriage which holds the liquid ejecting head be included, and at least a part of the circulation passages be provided on the inside of the carriage.

According to the above-mentioned configuration, the heat of the liquid in the liquid flow passage on the inside of the carriage may be retained. Therefore, since the heat of the liquid may be retained in the vicinity of the liquid ejecting head, the liquid having stable temperature may be supplied to the liquid ejecting head.

In the above-mentioned liquid ejecting apparatus, it is preferable that, on the outside of the carriage, the circulation passages be disposed so as to interpose the other liquid flow passages therebetween.

According to the above-mentioned configuration, since, on the outside of the carriage, the circulation passages are disposed so as to interpose the other liquid flow passages therebetween, the liquid in the liquid flow passage may be heated even on the outside of the carriage where the temperature decrease easily occurs by being exposed to the air outside.

In the above-mentioned liquid ejecting apparatus, it is preferable that the liquid ejecting head be able to move in a predetermined direction, the circulation passages be disposed at the outer sides of the other liquid flow passages in a liquid ejecting head movement direction, the circulation passage on the front side in the liquid ejecting head movement direction be outgoing circulation passages, and the circulation passage on the opposite side of the front side in the liquid ejecting head movement direction be incoming circulation passages.

According to the above-mentioned configuration, the liquid having high-temperature in the circulation passage may be supplied to the liquid flow passage which is likely cooled during the movement of the liquid ejecting head. Thereby, the temperature of the liquid to be supplied to the liquid ejecting head may be stabilized.

In the above-mentioned liquid ejecting apparatus, it is preferable that each of a plurality of the liquid flow passages supply a liquid having different colors to one another to the liquid ejecting head, and each of a plurality of the liquid flow passages have the circulation passage.

According to the above-mentioned configuration, since a plurality of the liquid flow passages are respectively provided with the circulation passages, the liquid having stable temperature may be supplied to the liquid ejecting head.

In the above-mentioned liquid ejecting apparatus, it is preferable that the liquid ejecting head be able to move in a predetermined direction, the circulation passages be disposed at the outer sides of the other liquid flow passages in the liquid ejecting head movement direction, and a switching mechanism capable of switching a flow direction of the liquid in the circulation passage in accordance with the liquid ejecting head movement direction be provided.

According to the above-mentioned configuration, since the flow direction of the liquid in the circulation passage is switched by the switching mechanism in accordance with the movement direction of the liquid ejecting head, the high-temperature liquid may be supplied to the liquid flow passage which is most likely to be cooled during the movement of the liquid ejecting head. Thereby, the temperature of the liquid to be supplied to the liquid ejecting head may be stabilized.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
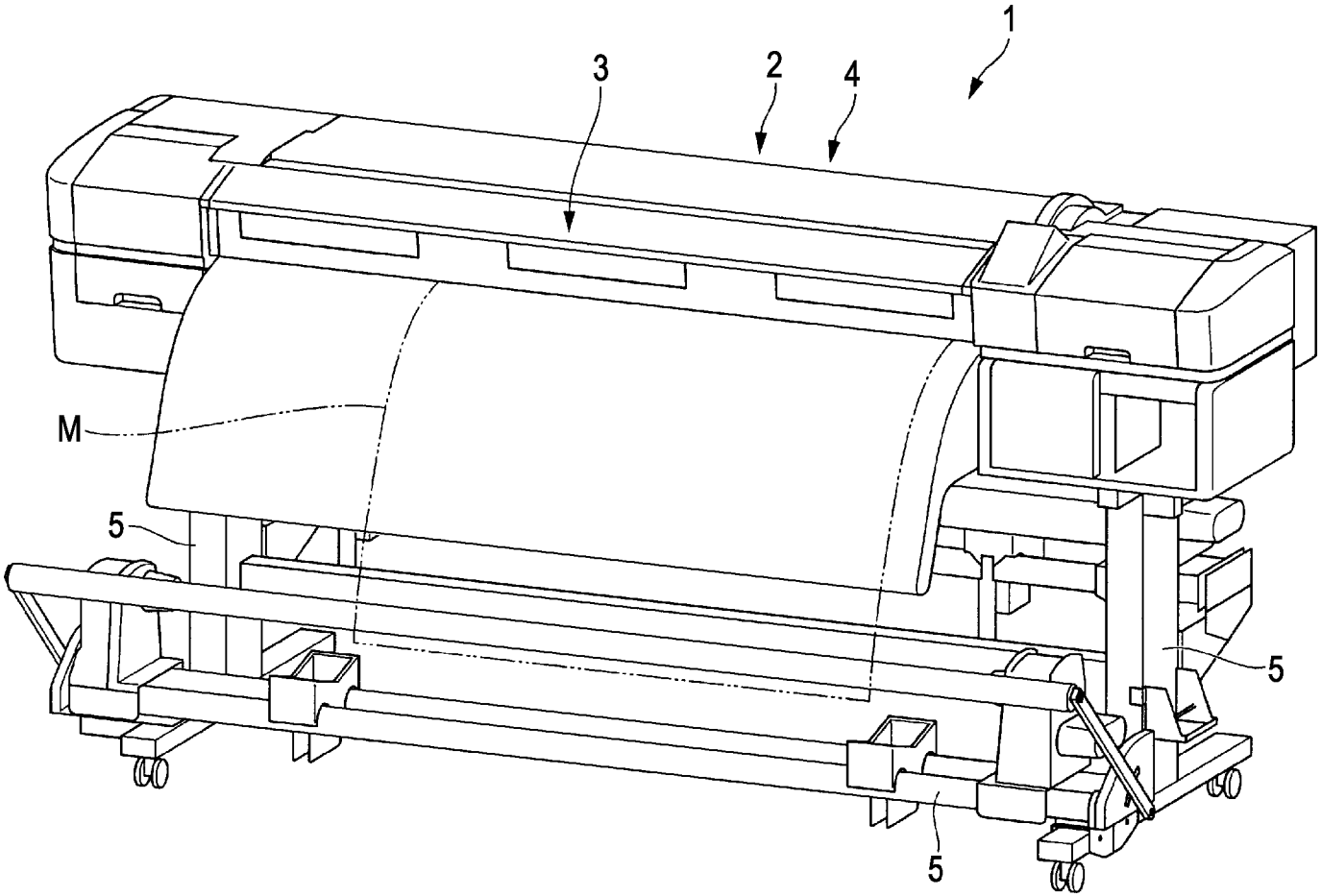
FIG. 1 is a perspective view illustrating a printer according to a first embodiment.

Hereinafter, embodiments of the recording apparatus according to the aspect of the invention will be described with reference to the drawings. Also, in order to make each member recognizable size, the scale of each member is appropriately changed in the drawings used in the following description.

In the embodiments, an ink jet type printer (hereinafter, simply referred to as a printer 1) will be described as a liquid ejecting apparatus according to the aspect of the invention by way of example.

First Embodiment

Figure 2:
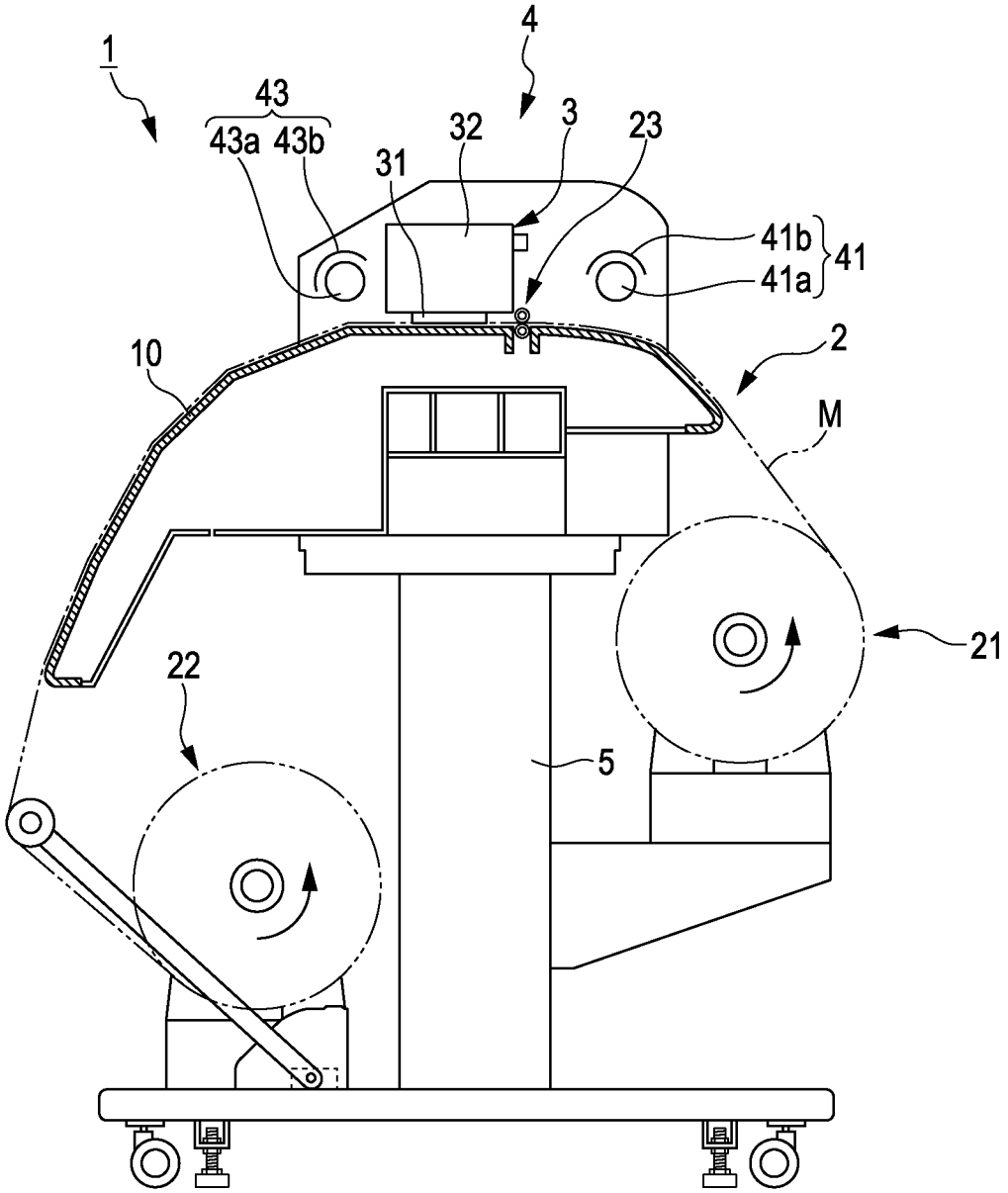
FIG. 2 is a cross-sectional view illustrating a schematic configuration of the printer according to the first embodiment.

FIG. 1 is a perspective view illustrating the appearance of the printer 1 according to the embodiment. FIG. 2 is a cross-sectional view illustrating a schematic configuration of the printer 1.

The printer (recording apparatus) 1 is a large format printer (LFP) which handles relatively large media M. The media M is a stripe-shaped medium with a width of about 64 inches, for example, and is formed of a vinyl chloride film, a paper or the like.

As shown in FIGS. 1 and 2, the printer 1 includes a transporting portion 2 which transports the media M using a roll-to-roll method, a recording portion 3 which records an image, a letter or the like by ejecting a liquid, i.e. an ink (for example, an ultraviolet-light curable ink) onto the media M, and a processing portion 4 which cures the ink ejected onto the media M by radiating ultraviolet-light thereto. Each of these components is supported on a main-body frame 5.

The transporting portion 2 includes an unwinding portion 21 for feeding the media M which is wound in a roll shape, a winding portion 22 for winding the fed media M in a roll shape, and a pair of transport rollers 23 which hold the media M and apply a transport force thereto on a transport path between the unwinding portion 21 and the winding portion 22. The unwinding portion 21, the winding portion 22 and the pair of transport rollers 23 are driven by a motor and a speed reducer (not shown).

The recording portion 3 includes an ink jet head 31 which ejects the ink onto the media M on a downstream side of the pair of transport rollers 23 on the transport path, and a carriage 32, to which the ink jet head 31 is mounted, capable of freely and reciprocally moving in a width direction. The ink jet head 31 is configured so as to be provided with a plurality of nozzles Nz (see FIG. 3), and to be able to eject an ultraviolet-light curable ink, which is selected in relation to the medium M and requires ultraviolet-light radiation. The ink jet head 31 is able to eject inks in a plurality of colors (five colors in the embodiment) and includes five nozzle rows which eject the ink of each color.

In the ink jet head 31, pressure generating chambers in which the ink to be ejected from each of the nozzles Nz is accommodated, a common ink chamber which is commonly communicated with each of the pressure generating chambers, and the like are formed as an ink flow passage. The ink supplied from pressure adjustment portions 30 to the inside of the ink jet head 31 is supplied to each of the pressure generating chambers via the common ink chamber and then is ejected from the nozzles Nz as ink droplets by a pressure variation in the pressure generating chamber.

A resin material, a photopolymerization initiator as a curing agent, and a solvent or a dispersion medium are chief materials of the ultraviolet-light curable ink. Functional fluid having a specific function may be formed by adding, to the chief materials, a coloring matter such as pigments or dyes and a functional material such as a surface modifier having, for example, a lyophilic or a lyophobic property. In the embodiment, pigments of cyan, magenta, yellow or white, for example, are added. The resin material of the ink is a material forming a resin film. The resin material is not particularly limited as long as the material is in the liquid phase at room temperature and becomes a polymer by polymerizing. Furthermore, a low-viscosity resin material is preferred, and being in a form of an oligomer is preferred. Being in a form of a monomer is more preferred. The photopolymerization initiator is an additive which acts on a crosslinkable group of a polymer and progresses a cross-linking reaction. A benzyl dimethyl ketal or the like may be used as the photopolymerization initiator, for example. The solvent or the dispersion medium is used for adjusting the viscosity of the resin material.

A media support portion 10 constitutes a part of the transport path of the media M. In addition, the media support portion 10 supports the media M by curving so as to be convex upward between the unwinding portion 21 and the winding portion 22.

The processing portion 4 includes an ultraviolet-light radiation portion 43 which radiate ultraviolet-light onto the media M further to the downstream side in the transport direction than the position where the recording portion 3 is provided.

The ultraviolet-light radiation portion 43 includes a light emitting portion 43*a* which radiates ultraviolet-light, and a reflector 43*b*.

The light emitting portion 43*a* is provided with a number of LED (Light Emitting Diode) elements in a linearly arranged manner. Each of the LED elements is an element which emits ultraviolet-light, which is an ultraviolet beam, by receiving the power supply. The reflector 43*b* is intended to reflect the ultraviolet-light emitted from the light emitting portion 43*a* and to radiate the ultraviolet-light toward a recording surface of the media M in a concentrated manner.

Meanwhile, the printer 1 according to the embodiment ejects a high-viscosity ultraviolet-light curable ink. In order to eject such a high viscosity ink from the ink jet head 31, it is necessary to lower the viscosity of the ink by heating. Heating the ink means raising the temperature of the ink up to a prescribed temperature.

In the embodiment, the temperature of the ink to be supplied to the ink jet head 31 is adjusted to a predetermined temperature by heating, whereby the viscosity of the ink is lowered so as to be accurately ejected from the ink jet head 31. Specifically, in the embodiment, the ink is heated to, for example, a temperature of 35° C. and then is ejected from the ink jet head 31 while the temperature of the ink is higher than 30° C.

Figure 3:
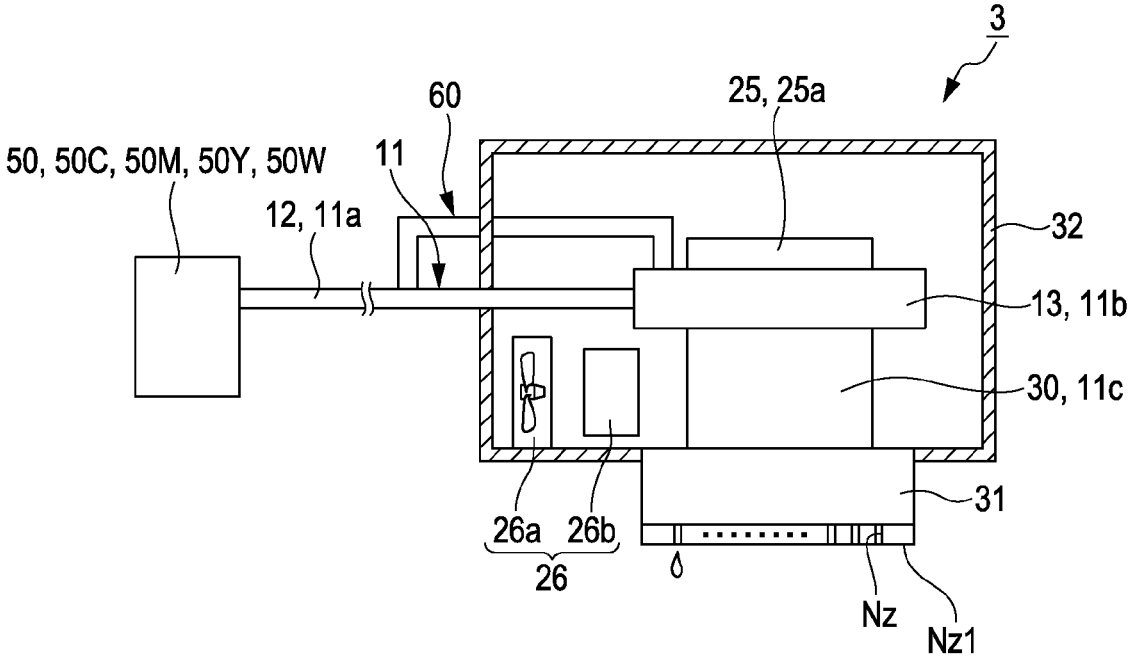
FIG. 3 conceptually illustrates an ink supply path of the printer according to the first embodiment.

FIG. 3 conceptually illustrates an ink supply path of the printer 1 according to the embodiment.

As shown in FIG. 3, the ultraviolet-light curable ink stored in the ink cartridge 50 is supplied to the ink jet head 31 which is mounted to the carriage 32 (recording portion 3) via a plurality (four in the embodiment) of ink flow passages 11. Also, a plurality (which is four in the embodiment) of the ink cartridges 50 are provided in accordance with the number of colors of inks which are discharged from the ink jet head 31. In the embodiment, the ink cartridge 50 is constituted of four ink cartridges 50C, 50M, 50Y and 50W in which inks in cyan, magenta, yellow and white color are accommodated respectively.

The ink flow passage 11 has a first flow passage portion 11*a*, a second flow passage portion 11*b* and a third flow passage portion 11*c*. The first flow passage portion 11*a* is constituted of a plurality of tubes 12 having flexibility and each of one ends thereof is connected to the ink cartridge 50. In addition, the second flow passage portion 11*b* is heated by a first heat source (heating portion) 25, and the third flow passage portion 11*c* is heated by a second heat source (heating portion) 26.

In the printer 1, the first heat source 25 and the second heat source 26 are provided in the carriage 32 in a sealed state. Thereby, the heat of the first heat source 25 and the second heat source 26 is efficiently transferred to the ink flow passage 11 (the second flow passage portion 11*b* and the third flow passage portion 11*c*). Also, heating efficiency of the ink flow passage 11 may be improved by circulating atmosphere in the carriage 32.

The second flow passage portion 11*b* is constituted of a flat flow passage 13 in which the ink flowing therethrough is heated by the first heat source 25. The third flow passage portion 11*c* is constituted of the pressure adjustment portions 30 which are provided between the flat flow passage 13 and the ink jet head 31.

Each of the pressure adjustment portions 30 is formed of a resin material such as a polypropylene. Each of the pressure adjustment portions 30 includes an ink chamber of which volume varies in accordance with an external pressure by being partitioned using an elastic sheet. The elastic sheet is deformable in a direction where the ink chamber is contracted or expanded. Furthermore, a pressure variation of the ink is absorbed by a damper function due to an operation of the elastic sheet. That is, each of the pressure adjustment portions 30 functions as a pressure damper due to a deformation of the elastic sheet. Therefore, the ink is supplied to the ink jet head 31 side in a state in which a pressure variation thereof is absorbed in the pressure adjustment portions 30. That is, the pressure adjustment portion 30 is configured as a liquid storage portion capable of temporarily storing the ink to be supplied to the ink jet head 31.

Figure 4:
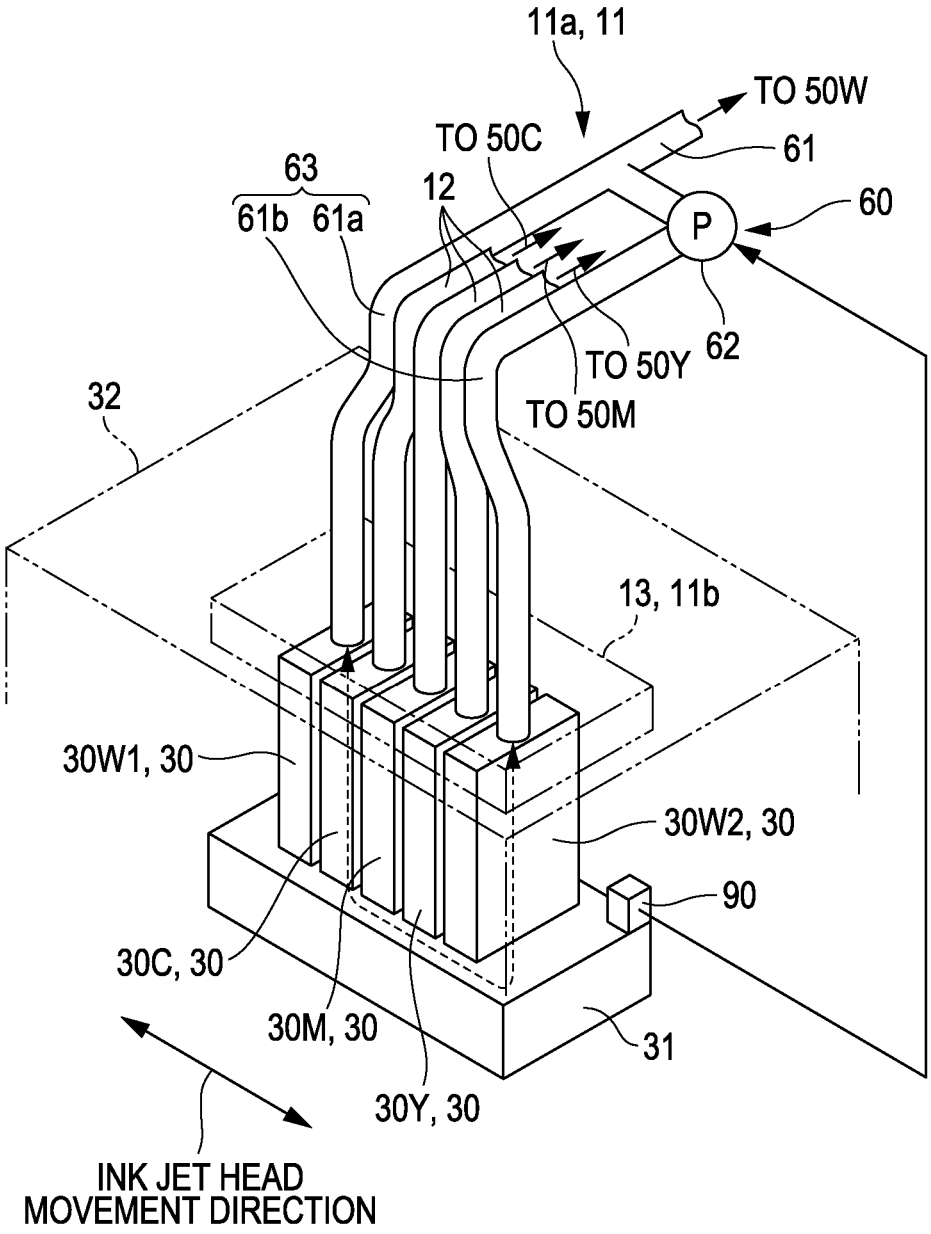
FIG. 4 illustrates a detailed configuration of an ink flow passage in the periphery of an ink jet head according to the first embodiment.

FIG. 4 illustrates a detailed configuration of the ink flow passage in the periphery of the ink jet head 31. As shown in FIG. 4, the printer 1 according to the embodiment includes five pressure adjustment portions 30, which correspond to the colors of the inks accommodated in the ink cartridges 50. Specifically, the printer 1 according to the embodiment has pressure adjustment portions 30C, 30M, 30Y, 30W1 and 30W2.

The inks from the ink cartridges 50C, 50M and 50Y are supplied to the pressure adjustment portions 30C, 30M and 30Y, respectively.

Furthermore, an ink from the ink cartridge 50W is supplied to the pressure adjustment portions 30W1 and 30W2. The pressure adjustment portions 30W1 and 30W2 to which ink in white color is supplied are disposed so as to interpose the pressure adjustment portions 30C, 30M and 30Y, to which inks in the other colors (which are cyan, magenta and yellow) are respectively supplied, therebetween.

The inks (which are inks in cyan, magenta and yellow colors) in the ink cartridges 50C, 50M and 50Y pass through the tubes 12 which constitute the first flow passage portion 11*a* of the ink flow passage 11. Then, the inks are supplied to the ink jet head 31 via the pressure adjustment portions 30C, 30M and 30Y. The ink in each color supplied to the ink jet head 31 is appropriately supplied to the pressure generating chamber via the common ink chamber in the ink jet head 31 and then is ejected from the nozzles Nz.

Meanwhile, in the embodiment, the ink (which is the ink in white color) in the ink cartridge 50W passes through ink tubes 61 which constitute the first flow passage portion 11*a* of the ink flow passage 11. Then the ink is supplied to the ink jet head 31 via the pressure adjustment portions 30W1 or 30W2.

The printer 1 includes the second heat source 26 capable of heating the inks in the pressure adjustment portions 30 which constitute the third flow passage portion 11*c* between the first heat source 25 and the ink jet head 31. The second heat source 26 has a heater 26*a* and a fan 26*b* which supplies the air heated by the heater 26*a* to the pressure adjustment portions 30 (the third flow passage portion 11*c*).

Subsequently, the inks which are temporarily stored in the pressure adjustment portions 30 may be heated. Therefore, the viscosity of the inks sent from the pressure adjustment portions 30 to the ink jet head 31 side is maintained at a predetermined viscosity, whereby the ink is satisfactorily supplied to the ink jet head 31 by smoothly flowing through the ink flow passages in the pressure adjustment portions 30.

Figure 5:
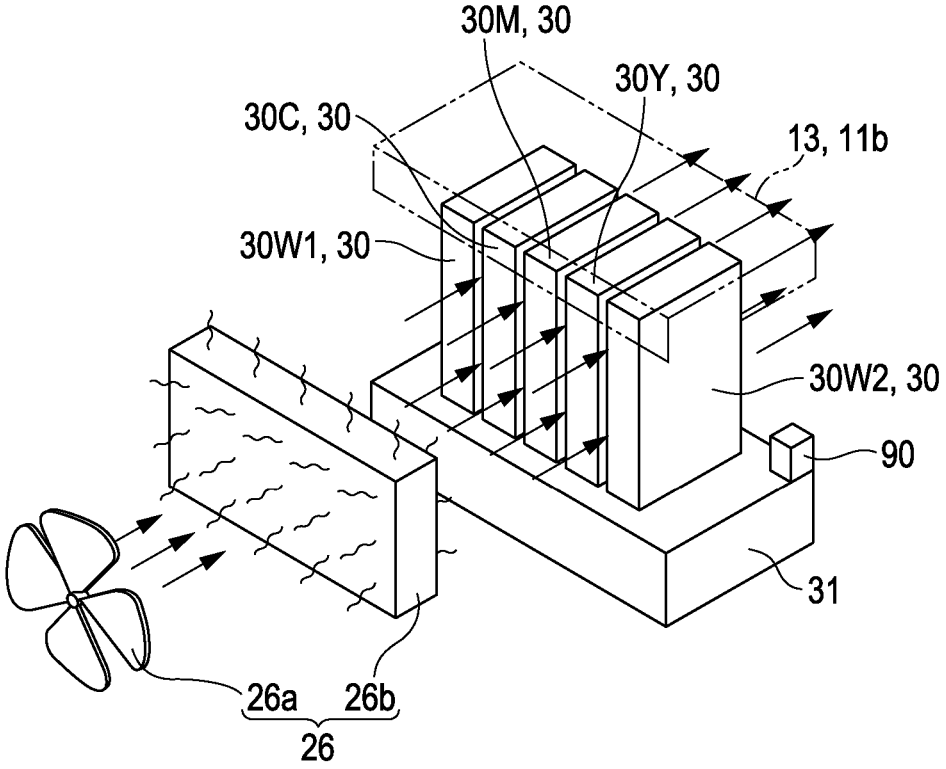
FIG. 5 illustrates a positional relationship between a second heat source and a pressure adjustment portion according to the first embodiment.

FIG. 5 illustrates a positional relationship between the second heat source 26 and the pressure adjustment portions 30C, 30M, 30Y, 30W1 and 30W2.

As shown in FIG. 5, each of the five pressure adjustment portions 30 is installed to the ink jet head 31 in an interval manner. In the second heat source 26, the air outside heated by the heater 26*a* is supplied to the pressure adjustment portions 30 by the fan 26*b*.

In the embodiment, each of the pressure adjustment portions 30 is disposed so as to be parallel to the blowing direction of the fan 26*b*, and an interval is provided between the adjacent pressure adjustment portions 30. Thereby, the warm air from the fan 26*b* may be efficiently blown on the pressure adjustment portions 30. Subsequently, the inks in the pressure adjustment portions 30 are heated efficiently, whereby the temperature of the inks is maintained at a predetermined temperature (35° C.)

Meanwhile, the ink heated by the first heat source 25 and second heat source 26 is supplied to the ink jet head 31 in the printer 1. However, the air in the printer 1 hits the ink jet head 31 during a movement of the carriage 32. In this case, since the air in the printer 1 is under 35° C., the ink jet head 31 is cooled. Therefore, since the temperature of the ink supplied to the ink jet head 31 is decreased, there is a possibility that the so-called discharge failure, which means that the ink increased in viscosity is not satisfactorily discharged from the nozzles Nz, may occur.

In the embodiment, the ink jet head 31 held in the carriage 32 (not shown) is moved along the direction of the arrow shown in FIG. 4. Namely, the printer 1 has a configuration capable of moving the ink jet head 31 along the array direction of a plurality of the pressure adjustment portions 30.

In the printer 1 according to the embodiment, the ink flow passage 11 has a circulation passage 60 which discharges, from the ink jet head 31, at least a part of the ink supplied to the ink jet head 31 without passing through the nozzles Nz, and circulates the discharged ink to the upstream side of the first heat source 25, as shown in FIG. 4.

The circulation passage 60 is mainly constituted of an ink tube 61 and a pump (switching mechanism) 62 provided in the ink tube 61. The ink tube 61 is a portion between the ink cartridge 50W and the first heat source 25 of the tubes 12, where the tubes 12 constitute the first flow passage portion 11*a* of the ink flow passage 11. The ink tube 61 has a branch portion 63 including a first branch portion 61*a* and a second branch portion 61*b* which are the two branched end portions of the ink tube 61 in the first heat source 25 side. The first branch portion 61*a* is communicated with the pressure adjustment portion 30W1 via the flat flow passage 13 and the second branch portion 61*b* is communicated with the pressure adjustment portion 30W2 via the flat flow passage 13.

Based on the above-mentioned configuration, the printer 1 supplies the ink in white color from the ink cartridge 50W, through the first branch portion 61*a* and the pressure adjustment portion 30W1, to the ink jet head 31 via the ink tube 61. The printer 1 can appropriately supply a part of the white ink supplied to the ink jet head 31 to the pressure generating chamber via the common ink chamber, and eject the ink from each of the nozzles Nz.

In addition, the printer 1 can make the circulation passage 60 function by driving the pump 62. In the circulation passage 60, for example, a part of the white ink, which is supplied to the ink jet head 31 via the pressure adjustment portion 30W1, is discharged from the ink jet head 31 to the pressure adjustment portion 30W2 while flowing only through the common ink chamber without passing through the pressure generating chamber and the nozzles Nz. Subsequently, the ink discharged from the ink jet head 31 is returned to the first branch portion 61*a* via the pressure adjustment portion 30W2, the second branch portion 61*b* and the pump 62. The ink returned to the first branch portion 61*a* is circulated to the ink jet head 31 via the first heat source 25 and the pressure adjustment portion 30W1 again.

Furthermore, at least on the outside of the carriage 32, the first branch portion 61*a* and the second branch portion 61*b* constituting the circulation passage 60 are disposed so as to interpose the tubes 12, which connect between the other ink cartridges 50C, 50M and 50Y and ink jet head 31, therebetween. In this case, the tubes 12, which are disposed in the area where the temperature of the tubes 12 is likely to be decreased by being exposed to the air outside of the carriage 32, can retain heat by the first branch portion 61*a* and the second branch portion 61*b* through which the ink having a stable temperature, which is kept by being circulated through the first heat source 25, flows. Also, on the outside of the carriage 32, it is possible to heat the inks in the tubes 12. Subsequently, it is possible to make the heating time of the ink, which is supplied to the first heat source 25 via the tubes 12, shortened.

In addition, the printer 1 can change the circulation direction of the ink in the ink jet head 31 by switching the drive of the pump 62. Specifically, the printer 1 switches the drive of the pump 62 in accordance with the movement direction of the ink jet head 31, as described below.

Furthermore, the printer 1 has a temperature sensor 90 capable of detecting the temperature of a nozzle surface Nz1 on which the nozzles Nz of the ink jet head 31 are formed, and the printer 1 can switch the drive of the pump 62 based on the detection result of the temperature sensor 90. In this case, if, when the ink jet head 31 (carriage 32) is stopped, the temperature of the nozzle surface Nz1 the ink jet head 31 is decreased, the printer 1 maintains the temperature inside of the ink jet head 31 by making the circulation passage 60 function as necessary.

In the circulation passage 60, a part of the white ink, which is supplied to the ink jet head 31 via the pressure adjustment portion 30W2, is discharged from the ink jet head 31 to the pressure adjustment portion 30W1 while flowing only through the common ink chamber without passing through the pressure generating chamber and the nozzles Nz. Subsequently, the ink discharged from the ink jet head 31 is returned to the second branch portion 61*b* via the pressure adjustment portion 30W1 and the first branch portion 61*a*. The ink returned to the second branch portion 61*b* is circulated to the ink jet head 31 via the first heat source 25 and the pressure adjustment portion 30W2 again.

Thus, a part of the white ink supplied to the ink jet head 31 is circulated to the upstream side of the first heat source 25 without being discharged from the nozzles Nz, whereby the printer 1 can supply the ink heated by the first heat source 25 to the pressure adjustment portions 30W1 and 30W2 again.

In the printer 1, since the ink jet head 31 is reciprocally moved along the predetermined direction, the pressure adjustment portions 30W1 and 30W2 are in a state in which the pressure adjustment portions 30W1 and 30W2 are disposed on the front side of the ink jet head 31 in the movement direction. In this case, the temperature is greatly decreased on the front side of the ink jet head 31 in the movement direction, whereby there is possibility that the temperature of the ink supplied to the ink jet head 31 may be decreased.

In the printer 1 according to the embodiment, the flow passages at the end portion, namely, which are the flow passages positioned on the front side of the ink jet head 31 in the movement direction, are circulated. In this case, since the ink heated by the first heat source 25 is circulated, the temperature decrease in the ink in the ink jet head 31 is prevented.

Meanwhile, the pressure adjustment portions 30C, 30M and 30Y are interposed between the pressure adjustment portions 30W1 and 30W2 in which the temperature of the ink is stable by circulating the ink through the circulation passage 60. Therefore, the ink in the ink flow passages at the end portion is circulated while being heated, but the ink in the ink flow passage, which is interposed between the ink flow passages at the end portions, is not circulated. Subsequently, although the temperature of the ink is decreased in the ink jet head 31 positioned at the end portion, the affection of the temperature decrease can be reduced by being interposed between the flow passages which are heated and circulated.

Meanwhile, the white ink stored in the ink cartridge 50W has a property such as the sedimentation of particles of the pigment tends to occur, compared to the inks in other colors. However, the printer 1 according to the embodiment adopts the configuration in which the white ink is circulated to the ink jet head 31 via the circulation passage 60, whereby it is possible to prevent the sedimentation of the white ink from occurring in the ink jet head 31.

Figure 6A:
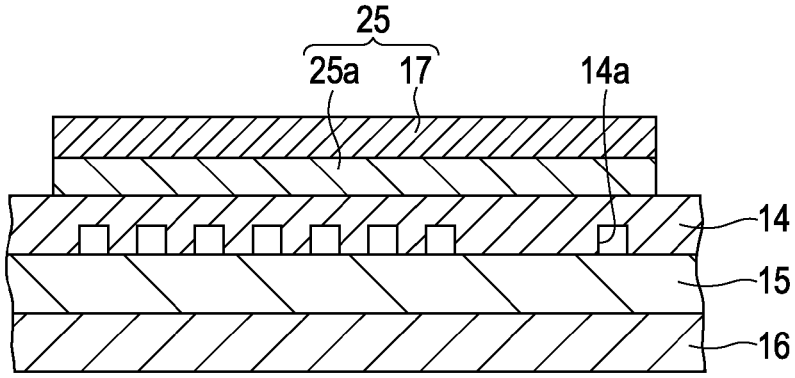
FIGS. 6A and 6B illustrate a configuration of a second flow passage portion and a first heat source according to the first embodiment.
Figure 6B:
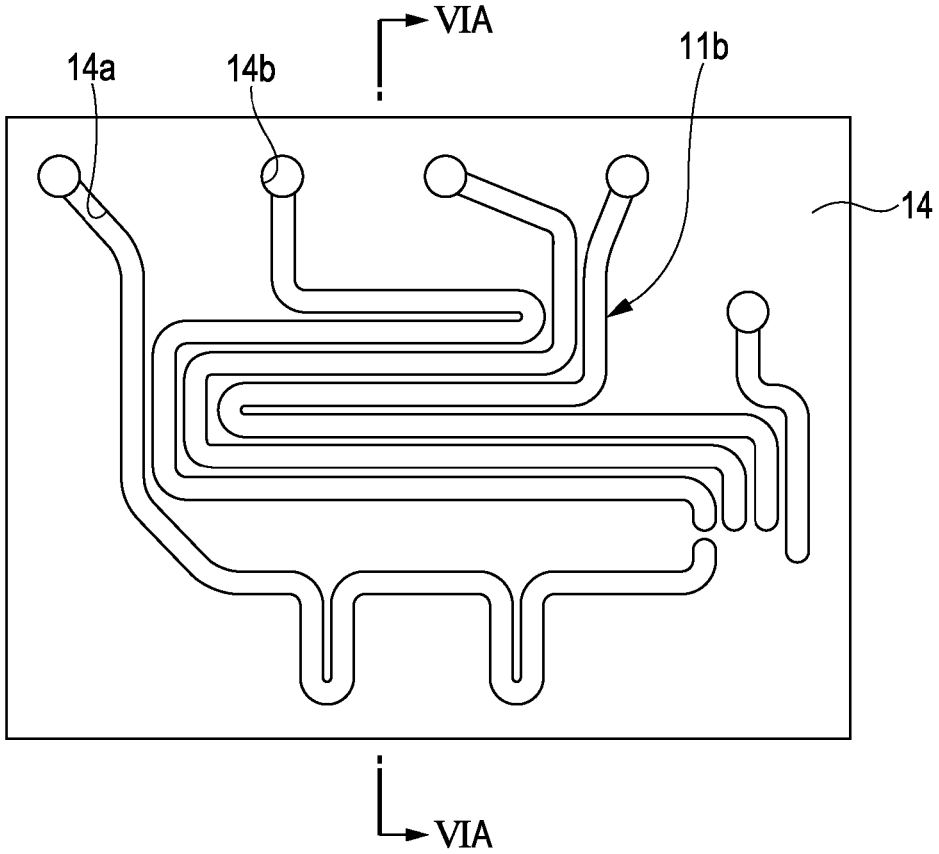

FIGS. 6A and 6B illustrate a configuration of the second flow passage portion 11*b* and the first heat source 25. FIG. 6A is a cross-sectional view of FIG. 6B taken along line VIA-VIA, illustrating the peripheral configuration of the second flow passage portion 11*b*. FIG. 6B illustrates the planar configuration of a metal plate which constitutes the flat flow passage 13.

The flat flow passage 13 is constituted of a plurality (five in the embodiment) of grooves 14*a* which are formed on the metal plate 14 shown in FIG. 6A. Since a material having high thermal conductivity is preferred as the metal plate 14, stainless steel is used as the metal plate 14 in the embodiment. The grooves 14*a* formed on the metal plate 14 are respectively connected to a plurality of the tubes 12, which constitute the above-described first flow passage portion 11*a*, via connection portions 14*b* which are respectively provided at one ends thereof. In addition, the other ends of the grooves 14*a* are respectively communicated with a plurality (five in the embodiment) of the above-described pressure adjustment portions 30C, 30M, 30Y, 30W1 and 30W2, which constitute the third flow passage portion 11*c*, in the area (not shown).

As shown in FIG. 6A, the flat flow passage 13 includes the metal plate 14 on which a plurality of the grooves 14*a* are formed, a sealing plate (sealing member) 15 which seals the surface on the side in which the grooves 14*a* are formed, and a fixing plate 16 which is provided on the opposite side of the metal plate 14 of the sealing plate 15. The metal plate 14 and the fixing plate 16 are fastened by screws at the area (not shown) while interposing the sealing plate 15 therebetween. That is, the grooves 14*a* are sealed by the fixing plate 16, and the second flow passage portion 11*b* is constituted by the fixing plate 16 and the grooves 14*a*.

The first heat source 25 is constituted from a heater 25*a* adhered to the flat flow passage 13. The heater 25*a* is formed of, for example, the film material in which the wiring operated by a resistance heating method is embedded. Specifically, the heater 25*a* is directly adhered to the metal plate 14. An insulating material 17 is adhered to the opposite surface side of the metal plate 14 of the heater 25*a*. Thereby, the heat of the heater 25*a* is efficiently transmitted to the metal plate 14.

As described above, since the first flow passage portion 11*a* is constituted by the grooves 14*a* which are formed on the metal plate 14, and the metal plate 14 is directly heated by the heater 25*a*, it is possible to efficiently heat the ink in the first flow passage portion 11*a* (grooves 14*a*). Therefore, it is possible to efficiently heat a plurality of the ink flow passages 11, which are constituted of a plurality of the grooves 14*a*, by the same heat source (which is the first heat source 25).

When the job command of the printing start is input, the printer 1 configured as described above operates as follows.

First, when the job command mentioned above is input, the printer 1 drives the first heat source 25 (which is the heater 25*a*) and the second heat source 26 (which is the heater 26*a* and the fan 26*b*), whereby heating the ink in the ink flow passage 11 (the second flow passage portion 11*b* and the third flow passage portion 11*c*).

In the embodiment, since the two-stage heating method is adopted, it is possible to stabilize the temperature of the ink to be supplied to the ink jet head 31. Additionally, in the two-stage heating method, the upstream side of the ink flow passage 11 is heated by the first heat source 25 and the downstream side of the ink flow passage 11 is heated by the second heat source 26 as described above.

Next, if the temperature of the ink in the ink flow passage 11 is maintained at the predetermined temperature, the media M is transported to the printing area of the media support portion 10 and then the ink jet head 31 of the recording portion 3 starts the printing process on the media M. The ink jet head 31 in a state of being mounted to the carriage 32 performs the printing process while moving reciprocally in the width direction of the media M.

The light emitting portion 43*a* of the processing portion 4 radiates ultraviolet-light with respect to the media M on which the ink is ejected. Since the ink used in the embodiment is an ultraviolet-light curable type as described above, and contains a photopolimerization initiator which initiates polymerization by ultraviolet-light, the surface of the ink is immediately solidified or cured. Thereby, the ink is cured and fixed on the media M. As described above, in the embodiment, the ink droplets are cured by radiating ultraviolet-light immediately after being ejected on the media M, whereby it is possible to perform a high-quality printing process of less bleeding due to suppressing the bleeding of the ink droplets.

Furthermore, in the embodiment, since the ink, which is circulated to upstream of the first heat source 25 by circulation passage 60, is supplied to the ink jet head 31 while being reheated, it is possible to maintain the ink flowing in the circulation passage 60 in state of being heated to the predetermined temperature. Therefore, the circulation passage 60 (the first branch portion 61*a* and the second branch portion 61*b*) is disposed to the ink flow passage 11, which is on the front side where the temperature decrease easily occurs by the movement of the ink jet head 31, among a plurality of the ink flow passages 11. Thereby, it is possible to stabilize the temperature of the liquid to be supplied to the ink jet head 31, even in the configuration where the ink jet head 31 is moved.

In addition, the configuration of the circulation passage 60 is also adopted as a counter-measure of the sedimentation of the white ink. Therefore, it is possible that the ink having a stable temperature may be supplied to the ink jet head 31, and the printer 1 having high added-value such as a suppressed sedimentation of the white ink may be provided.

The invention is not limited to the above-described embodiment, and may be appropriately changed in a scope without departing from the spirit of the invention. For example, in the above-described embodiment, the printer 1 in which a plurality of the pressure adjustment portions 30 are disposed along the movement direction of the ink jet head 31 is exemplified, but the invention may be also adopted to the printer 1 in which a plurality of the pressure adjustment portions 30 are disposed along the direction perpendicular to the movement direction of the ink jet head 31.

Figure 7:
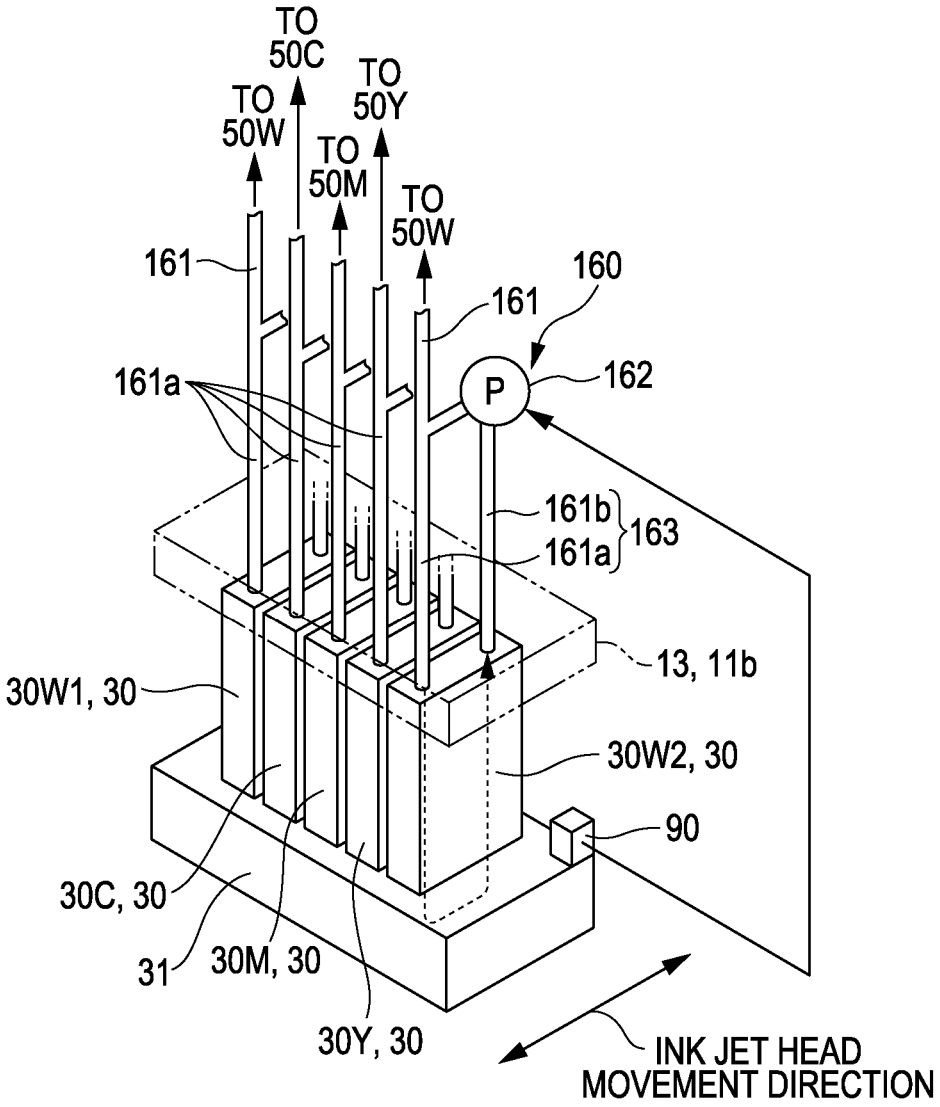
FIG. 7 illustrates a detailed configuration of an ink flow passage in the periphery of an ink jet head according to a second embodiment.

FIG. 7 illustrates a detailed configuration of the ink flow passages in the periphery of the ink jet head 31 of the printer 1 according to a modified example.

As shown in FIG. 7, in the modified example, circulation passages 160 are respectively provided to a plurality of the pressure adjustment portions 30.

The circulation passage 160 provided to the pressure adjustment portion 30W2 will be described by way of example. Configurations of the other circulation passages 160 which are provided to the other pressure adjustment portions 30W1, 30C, 30M and 30Y are the same.

The circulation passage 160 is mainly constituted of ink tube 161 which is provided between the ink cartridge 50W and the first heat source 25, and a pump 162 which is provided in the ink tube 161. The ink tube 161 has a branch portion 163 including a first branch portion 161*a* and a second branch portion 161*b* which are the two branched end portions of the ink tube 161 in the first heat source 25 side. Each of the first branch portion 161*a* and the second branch portion 161*b* is communicated with the pressure adjustment portion 30W2 via the flat flow passage 13.

Based on the above-mentioned configuration, the printer 1 supplies the ink in white color from the ink cartridge 50W, through the first branch portion 161*a* and the pressure adjustment portion 30W1, to the ink jet head 31 via the ink tube 161. The printer 1 can appropriately supply a part of the white ink supplied to the ink jet head 31 to the pressure generating chamber via the common ink chamber, and eject the ink from each of the nozzles Nz.

In addition, the printer 1 can make the circulation passage 160 function by driving the pump 162. In the circulation passage 160, for example, a part of the white ink, which is supplied to the ink jet head 31 via the pressure adjustment portion 30W2, is discharged from the ink jet head 31 to the pressure adjustment portion 30W2 while flowing only through the common ink chamber without passing through the pressure generating chamber and the nozzles Nz. Subsequently, the ink discharged from the ink jet head 31 is returned to the first branch portion 161*a* via the pressure adjustment portion 30W2, the second branch portion 161*b* and the pump 162. The ink returned to the first branch portion 161*a* is circulated to the ink jet head 31 via the first heat source 25 and the pressure adjustment portion 30W2 again.

Furthermore, in the modified example, the printer 1 can switch the drive of the pump 162 based on the detection result of the temperature sensor 90 capable of detecting the temperature of the nozzle surface Nz1 on which the nozzles Nz of the ink jet head 31 are formed.

The printer 1 according to the modified example supplies the ink in the outgoing circulation passage 160 with respect to the ink tube 161 (the first branch portion 161*a* or the second branch portion 161*b*) which is disposed on the front side of the ink jet head 31 in the movement direction of the ink jet head 31. Specifically, for example, when the ink jet head 31 is moved in the direction of lower left in FIG. 7, the printer 1 may make the pump 162 of the circulation passage 160 driven such that the first branch portion 161*a* becomes an outgoing circulation passage as shown by the arrow in FIG. 7.

In this case, it is possible to supply the ink, which is reheated by the first heat source 25, to the front side of the pressure adjustment portion 30W2 in the movement direction, where the effect of the temperature decrease in the internal space thereof easily act,'via the circulation passage 160. Subsequently, the temperature decrease in the ink in the pressure adjustment portion 30W2 is prevented, whereby it is possible to stabilize the temperature of the ink in white color which is supplied to the ink jet head 31.

In the printer 1, it is possible to eject a part of the ink in the other colors supplied to the ink jet head 31 from the nozzles Nz in the same manner. Also, with respect to the other circulation passages 160, it is possible to circulate the ink to the ink jet head 31 again by discharging the ink from the ink jet head 31 without passing through the nozzles Nz by driving the pump 162.

In the modified example described above, since the circulation passages 160 are respectively provided to the pressure adjustment portions 30, it is possible to stabilize the temperature of the ink supplied to the ink jet head 31. Furthermore, although the modified example adopts the configuration in which two pressure adjustment portions 30W1 and 30W2 in accordance with the white ink are provided, the configuration in which only single pressure adjustment portion is provided can be adopted as well.

Also, in the above-described embodiment, the configuration in which the first heat source 25 and the second heat source 26 are provided is exemplified. However, the configuration in which either one of the first heat source 25 or second heat source 26, or three or more heat sources are provided is also adoptable.

Furthermore, the color of the ink ejected from the ink jet head 31 may differ from the color in the above-described embodiment. Although the drive of the pump 162 is switched based on the detection result of the temperature sensor 90 in the above-described embodiment, the temperature sensor 90 may not be used. Also, although the drive of the pump 162 is switchable in the first embodiment, the drive of the pump 162 may not be switchable.

In the embodiment, although the printer 1 is exemplarily described as a recording apparatus, the recording apparatus is not limited thereto. The recording apparatus may be a copying machine, a facsimile or the like.

As a liquid ejecting apparatus, a recording apparatus that ejects or discharges a liquid aside from ink may be employed as well. The invention can be applied to various types of recording apparatuses that are provided with recording head or the like that discharges miniature-sized liquid droplets, for example. Note that the droplets refers to the state of the liquid ejected from the above-mentioned recording apparatus, and is intended to include granule forms, teardrop forms, and forms that pull tails in a string-like form therebehind. Furthermore, the liquid referred to here can be any material capable of being ejected by the recording apparatus. For example, any matter can be used as long as the matter is in its liquid phase, including liquids having high or low viscosity, sol, gel water, other inorganic solvents, organic solvents, liquid solutions, liquid resins, and fluid states such as liquid metals (metallic melts); furthermore, in addition to liquids as a single state of a matter, liquids in which the particles of a functional material composed of a solid matter such as pigments, metal particles, or the like are dissolved, dispersed, or mixed in a liquid carrier are included as well. In addition, the ink (ultraviolet-light curable ink) described in the above embodiment is exemplified as a representative example of a liquid. However, if the viscosity of liquid is high, the other liquids are applicable instead of the ultraviolet-light curable ink as well. Also, as the media M, a functional paper capable of thinly thermal-expanding, a substrate or a metal plate is included aside from a paper, a plastic film such as a vinyl chloride film, or the like. Additionally, the media M is not limited to a stripe shape, and may be a precut recording medium.

What is claimed is:

1. A liquid ejecting apparatus comprising:

a liquid ejecting head having nozzles that eject a liquid;

a plurality of liquid flow passages where the liquid to be supplied to the liquid ejecting head flows; and a heating portion that heats the liquid in the liquid flow passages, wherein the liquid flow passages include circulation passages where the liquid supplied to the liquid ejecting head is circulated to upstream of the heating portion by being discharged from the liquid ejecting head without passing through the nozzles; and non-circulation passages where the liquid supplied to the liquid ejecting head is not able to be circulated to upstream of the heating portion by being discharged from the liquid ejecting head without passing through the nozzles, and wherein the circulation passages are disposed at outer sides of the other liquid flow passages and are disposed so as to interpose the non-circulation passages between the circulation passages.

2. The liquid ejecting apparatus according to claim 1, wherein a carriage that holds the liquid ejecting head is included, and wherein at least a part of the circulation passages is provided on the inside of the carriage.

3. The liquid ejecting apparatus according to claim 1, wherein the liquid ejecting head is able to move in a predetermined direction, and the circulation passages are disposed at the outer sides of the other liquid flow passages in a liquid ejecting head movement direction, and wherein the circulation passage on the front side in the liquid ejecting head movement direction is an outgoing circulation passage, and the circulation passage on the opposite side of the front side in the liquid ejecting head movement direction is an incoming circulation passage.

4. The liquid ejecting apparatus according to claim 1, wherein the liquid ejecting head is able to move in a predetermined direction, and the circulation passages are disposed at the outer sides of the other liquid flow passages in the liquid ejecting head movement direction, and wherein a switching mechanism configured to switch a flow direction of the liquid in the circulation passage in accordance with the liquid ejecting head movement direction is provided.

* * * * *